US010781757B2

(12) United States Patent
Bilan et al.

(10) Patent No.: US 10,781,757 B2
(45) Date of Patent: Sep. 22, 2020

(54) VARIABLE VALVE DRIVE OF AN INTERNAL COMBUSTION ENGINE

(71) Applicant: Schaeffler Technologies AG & Co. KG, Herzogenaurach (DE)

(72) Inventors: Adrian Bilan, Fürth (DE); Frank Himsel, Obermichelbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/512,443

(22) Filed: Jul. 16, 2019

(65) Prior Publication Data

US 2020/0032718 A1 Jan. 30, 2020

(30) Foreign Application Priority Data

Jul. 26, 2018 (DE) ..... 10 2018 118 099

(51) Int. Cl.

| | |
|---|---|
| ***F01L 1/34*** | (2006.01) |
| ***F02D 13/02*** | (2006.01) |
| ***F01L 1/14*** | (2006.01) |
| ***F01L 1/18*** | (2006.01) |

(52) U.S. Cl.

CPC ..... *F02D 13/0207* (2013.01); *F01L 1/143* (2013.01); *F01L 1/18* (2013.01); *F01L 2001/186* (2013.01); *F01L 2305/02* (2020.05); *F01L 2810/04* (2013.01)

(58) Field of Classification Search

CPC ..... F02D 13/0207; F01L 1/143; F01L 1/18; F01L 2001/186; F01L 2105/02; F01L 2810/04

See application file for complete search history.

(56) References Cited

U.S. PATENT DOCUMENTS

| | | | | |
|---|---|---|---|---|
| 5,544,626 | A | 8/1996 | Diggs et al. | |
| 5,749,340 | A * | 5/1998 | Warburton | F01L 1/143 123/90.16 |
| 6,499,451 | B1 | 12/2002 | Hendriksma et al. | |
| 2015/0128890 | A1* | 5/2015 | Cecur | F01L 1/185 123/90.16 |

FOREIGN PATENT DOCUMENTS

| | | | |
|---|---|---|---|
| DE | 10137490 | A1 | 2/2003 |
| DE | 10155801 | A1 | 5/2003 |
| DE | 102015221037 | A1 | 8/2016 |
| DE | 102017101792 | A1 | 8/2018 |
| JP | 2004108252 | A | 4/2004 |

* cited by examiner

*Primary Examiner* — Zelalem Eshete
(74) *Attorney, Agent, or Firm* — Matthew V. Evans

(57) ABSTRACT

A variable valve drive of an internal combustion engine is provided that includes at least one gas exchange valve, the valve stroke of said gas exchange valve predefined by cams of a camshaft, and by at least one switchable rocker arm. The switchable rocker arm, having a first lever and a second lever, selectively transmits cam lift to the gas exchange valve. The second lever is selectively coupled to the first lever by a coupling. The coupling is activatable by an elongated activation arm on which one leaf spring is disposed for the coupling of the switchable rocker arm. The elongated activation arm is longitudinally displaceable from a locking position to an unlocking position by a linear actuator. A damper mass is disposed or configured to be capable of oscillating on the elongated activation arm and/or on the leaf spring of the elongated activation arm.

17 Claims, 7 Drawing Sheets

VARIABLE VALVE DRIVE OF AN INTERNAL COMBUSTION ENGINE

CROSS-REFERENCE TO RELATED APPLICATIONS

This application claims priority under 35 U.S.C. Section 119 of German Patent Application No. DE 10 2018 118 099.3 filed Jul. 26, 2018, the disclosure of which is incorporated herein by reference.

TECHNICAL FIELD

This disclosure relates to a variable valve drive of an internal combustion engine.

BACKGROUND

A variable valve drive is known from DE 10 2017 101 792 A1. This valve drive has a multiplicity of switchable rocker arms which are activatable by means of an elongated activation arm that is guided so as to be longitudinally displaceable on a cylinder head, wherein this activation arm has one connection element, which can be configured as a leaf spring, for each of the rocker arms to be activated. The axial displacement of the elongated activation arm is performed by a linear actuator that can be embodied as an electromagnet. By temporarily energizing and de-energizing the electromagnet, the tappet of the latter is axially retracted or deployed in order for the elongated activation arm to be displaced.

By virtue of the conjoint activation of the assigned rocker arms by means of the elongated activation arm and the leaf-spring-type connection elements fastened to the latter, in conjunction with a temporally rapid actuation, or an actuation at a comparatively high frequency of the electromagnet serving for displacing the elongated activation arm, undesirable oscillations and, associated therewith, erroneous switching of rocker arms can arise. This lies in that the linear actuator has a very short movement period of the armature of said linear actuator from an initial position to an axially maximum terminal position in which said armature axially displaces the elongated activation arm. This short movement period acts like an impulse, on account of which the elongated activation arm is intensely accelerated from the resting position of said activation arm. On account thereof, said activation arm loses contact with the tappet of the linear actuator, at the latest when said tappet returns to the terminal position. The elongated activation arm is subsequently decelerated by a resetting mechanism and is in an accelerated manner moved back to the tappet of the linear actuator until said activation arm impacts the tappet. Disadvantageous oscillations in the linear actuator, in the elongated activation arm, in the leaf springs, and in the switchable rocker arms are created in the motion sequence described, as is visualized in FIG. 5.

SUMMARY

The disclosure is therefore based on the object of proposing a valve drive having switchable rocker arms of the type mentioned at the outset, said valve drive by means of a linear actuator being adjustable in a oscillation-reduced manner.

This object is achieved by a variable valve drive which has the features described herein.

The disclosure thus proceeds from a variable valve drive of an internal combustion engine, having at least one gas exchange valve of identical function per cylinder, the valve stroke of said gas exchange valve predefined by cams of a camshaft and by means of at least one switchable rocker arm. The switchable rocker arm, having a first lever and a second lever, selectively transmits cam lift to the gas exchange valve. One end of one of the two levers is supported by an assigned support element that is mounted on a housing side. Another end of one of the two levers is supported on a valve stem of the gas exchange valve. The second lever is pivotably mounted to the first lever by means of a journal pin. The second lever, arranged with a roller to contact the cam, is selectively coupled to the first lever by means of a coupling. The coupling is activatable by means of an elongated activation arm on which one leaf spring is disposed for each coupling of one or more switchable rocker arms. The elongated activation arm, subjected to a resetting force of a resetting assembly, is longitudinally displaceable from a locking position to an unlocking position by means of a linear actuator.

In order for the object mentioned to be achieved, it is provided in the case of this valve drive that at least one damper mass is disposed or configured so as to be capable of oscillating on the elongated activation arm and/or on at least one leaf spring fastened to said elongated activation arm.

On account of this construction, undesirable oscillations within the valve drive, for example in the region of the linear actuator, of the elongated activation arm, of the leaf springs, as well as the switchable rocker arms are at least reduced and at best completely neutralized. Moreover, the noise generation of the valve drive is reduced. A space-saving synchronous activation of the coupling elements of the individual switchable rocker arms by way of only one central linear actuator is possible on account of the leaf springs which are disposed on the elongated activation arm and can be configured to be contoured. The natural frequency of the damper mass that is disposed in a oscillation-capable manner is chosen in such a manner that the harmful oscillation energy on account of said damper mass is neutralized by the resonant frequency of the valve drive and/or is converted to oscillation-related thermal energy.

According to one embodiment, it is provided that the at least one damper mass is disposed or configured on the end side on a pendulum arm which by way of the damper-mass-free end thereof is articulated so as to be freely pivotable on the elongated activation arm. Consequently, a construction which can make do without any additional spring elements is provided.

In the case of one other embodiment, it is provided that the at least one damper mass is formed by at least one ball, wherein said ball is disposed on the elongated activation arm so as to be displaceable in an axially sprung manner between two mutually opposite damper springs. On account thereof, a three-dimensionally space-saving integration of the damper mass in the elongated activation arm is achieved.

According to one further embodiment, it can be provided that the at least one damper mass is formed by at least one integral thickening on at least one leaf spring. Consequently, a configuration of the necessary damper mass is implementable without any additional constructive components.

The at least one thickening can be formed by folding over at least once a material portion of at least one leaf spring. On account thereof, the at least one damper mass can be configured integrally on the elongated activation arm by means of known forming methods such as, for example, edge-bending, folding, rabbeting, or the like.

The at least one thickening can be linked in a sprung manner to the leaf spring by means of a single-ply material web of said leaf spring. Consequently, a damper mass that has been integrally shaped by means of thickening can at the same time be linked in a sprung manner to the elongated activation arm in order for a spring-mass system to be achieved.

It is furthermore provided that the linear actuator can be configured as an electromagnet having an armature that is guided so as to be axially movable in a coil, wherein the armature at an axial end is rigidly connected to a tappet. A reliable axial displacement of the elongated activation arm is ensured on account of the electromagnet. The fluid lines, which are otherwise required for activating the coupling elements with the aid of pneumatic or hydraulic cylinders and which in spatial terms are difficult to integrate in a cylinder head of the internal combustion engine, can be dispensed with. An electric line having two poles and a comparatively small line cross section is sufficient for energizing the electromagnet.

Moreover, it can advantageously be provided that the elongated activation arm at one axial end thereof has an angled contact tab on which the tappet of the linear actuator can engage for activating the elongated activation arm. Consequently, the tappet can act on the elongated activation arm only so as to push but not actively pull so that the transmission of vibrations between the mentioned components of the valve drive is reduced, said oscillations under certain circumstances potentially leading to material failure and increased noise emissions.

In terms of the switchable rocker arms it can furthermore be provided that the respective coupling of the switchable rocker arms has a locking bolt which is displaceable so as to be parallel to the first lever and has a guide pin which is received in a diagonally running groove-type gate-type guide of an activation bolt, wherein the activation bolt is oriented so as to be transverse to the locking bolt and by means of the spring element is pretensioned in an axially outward manner in the direction of the leaf spring assigned to the respective coupling. On account thereof, a spatially particularly compact construction of the couplings of the switchable rocker arms is provided.

Each locking bolt can have a protrusion which in the locking position of the switchable rocker arm engages below at least portions of the bearing face of the second lever. On account thereof, a reliable locking of the two levers of the switchable rocker arm that acts on one side is provided.

The elongated activation arm can be guided in guide elements so as to be axially displaceable on a cylinder head of the internal combustion engine. Consequently, a space-saving disposal of the elongated activation arm on the cylinder head of the internal combustion engine is guaranteed. The elongated activation arm as well as the leaf springs, configured so as to be contoured, for example, have a comparatively high mechanical rigidity and can be embodied in a simple as well as cost-effective manner as stamped components from a steel sheet or from a light-metal sheet. Alternatively thereto, the leaf springs can also be produced as separate sheet-metal formed parts and be connected in a permanent and vibration-resistant manner to the elongated activation arm by means of suitable fastening elements such as, for example, rivets, bolts or screws.

In order for any migration or kinking of the elongated activation arm under an operative load to be avoided, the activation arm can be guided so as to be axially displaceable in a multiplicity of axially uniformly mutually spaced apart guide openings on the cylinder head of the internal combustion engine. At least some of said guide openings for the elongated activation arm for reasons of simplified ease of production can be integrated in the bearing caps of an assigned camshaft.

BRIEF DESCRIPTION OF THE DRAWINGS

In order for the disclosure to be more readily understood, a drawing in which exemplary embodiments are illustrated is appended to the description. In the drawings.

DETAILED DESCRIPTION

Figure 1:
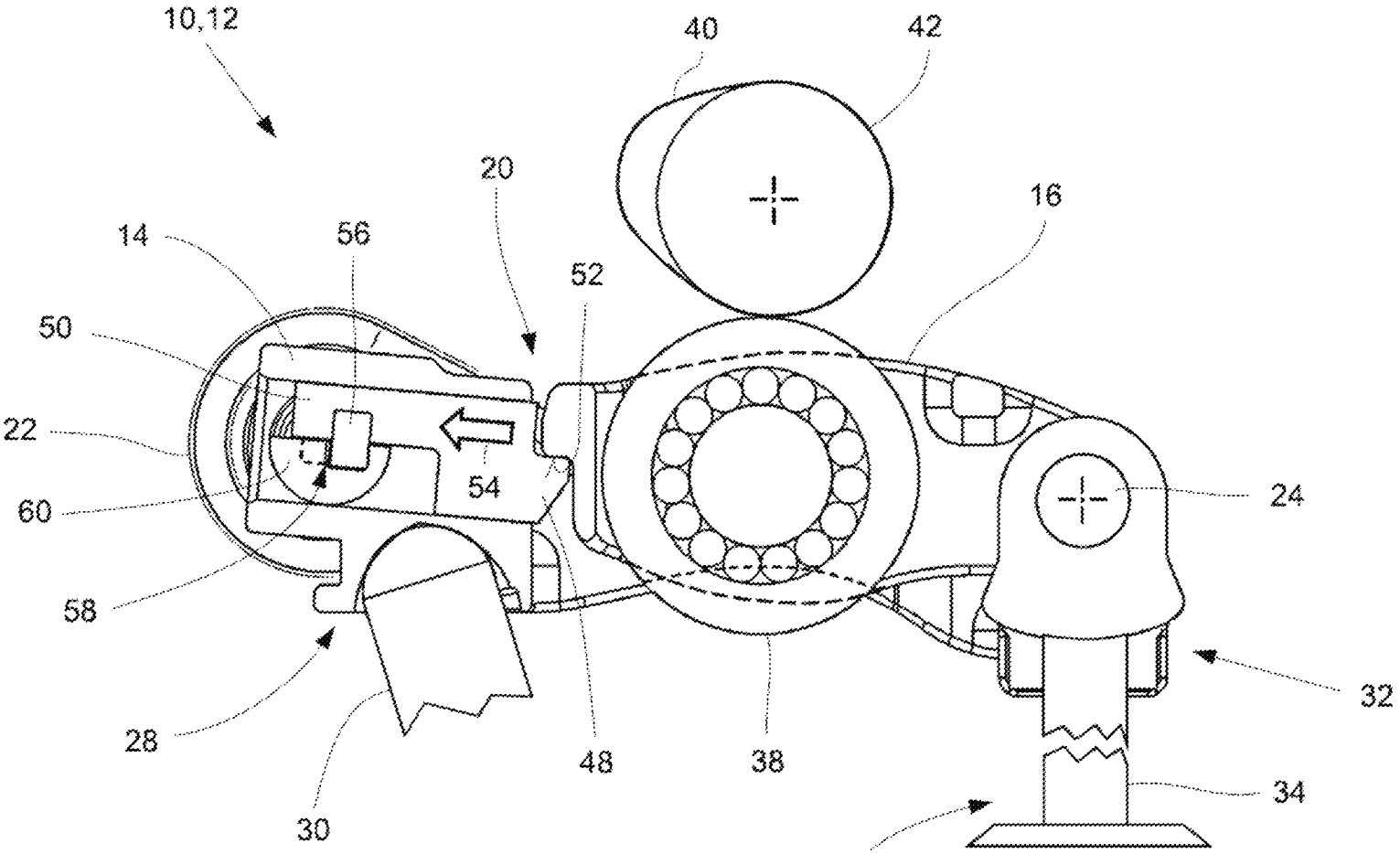
FIG. 1 shows a schematic lateral view of a switchable rocker arm of a valve drive in a locking position thereof.

Accordingly, FIG. 1 shows a schematic lateral view of a switchable rocker arm 12 of a variable valve drive 10. The valve drive 10 is part of a reciprocating piston internal combustion engine (not illustrated in more detail) and serves for activating inlet or outlet valves of the internal combustion engine. The switchable rocker arm 12 has a frame-shaped first lever 14 and a second lever 16 that is disposed so as to be mounted pivotably in said first lever 14. Moreover, the rocker arm possesses a coupling 20 by means of which the two levers 14, 16 are capable of being fixedly coupled together such that the second lever 16 can no longer swing in relation to the first lever 14. The coupling 20 in FIG. 1 is situated in the locking position thereof. In the unlocking position (not illustrated here) the first lever 14 and the second lever 16 by means of the coupling 20 are mechanically decoupled from one another such that the second lever 16 can pivot in relation to the first lever 14.

A first end 28 of the frame-shaped first lever 14 is supported by means of a support element 30 which is received on the cylinder head 26 and has an integrated hydraulic valve lash compensation element. The first lever 14 at the second end 32 thereof that faces away from said support element 30 is supported by way of a journal pin 24 on a valve stem 34 of a gas exchange valve 36 of the internal combustion engine. A roller 38 which is in contact with a cam 40 of a rotatable camshaft 42 of the internal combustion engine and which for minimizing the friction of the valve drive 10 is fastened so as to be rotatably mounted on the second lever 16. The two levers 14, 16 by means of the spring force of a contact pressure spring 22 which is configured as a leg spring are mutually braced in such a manner that the second lever 16 is constantly pressed against the assigned cam 40.

In the locking position illustrated in FIG. 1, a latch-type protrusion 48 of a locking bolt 50 of the coupling 20 engages below a lower-side bearing face 52 of the second lever 16 such that the second lever 16 is reliably locked in an oscillation-resistant manner to the first lever 14. In the locking position of the switchable rocker arm 12, the typical activation of the gas exchange valve 36 is performed by the rotating cam 40 which is in contact with the roller 38 of the second lever 16 and periodically presses down the roller 38, on account of which the first lever 14 which, by means of the coupling 20, is locked to the second lever 16 and is likewise conjointly moved and activates the gas exchange valve 36.

In order for the rocker arm 12, proceeding from the locking position shown in FIG. 1, to be switched to the unlocking position it is necessary for the locking bolt 50 to be axially displaceable in the first lever 14 to be displaced axially so far in the direction of the first end 28 of the first lever 14 that the latch-type protrusion 48 no longer engages below the bearing face 52 of the second lever 16 but releases the bearing face 52. For this purpose, the locking bolt 50 includes a guide pin 56 (possibly cylindrical in shape) arranged in a lower side, which is received in a diagonally running, groove-type gate-type guide 58 of an activation bolt 60 of the first lever 14, said activation bolt 60 being oriented and displaceable transversely to the locking bolt 50, that is to say, perpendicularly to the image plane. The displacement of the activation bolt 60 which is performed perpendicularly to the image plane is performed by means of an elongated activation arm 84, illustrated for example in FIG. 2, which here is configured as a flexurally rigid thrust strip, for example, to which orthogonally disposed leaf springs 82 are fastened (see FIGS. 2 to 4, as well as FIGS. 6 to 8).

The first lever 14 and the second lever 16, in terms of the pivotability of the second lever 16, are mechanically decoupled from one another in the unlocking position such that the rotating cam 40 on the camshaft 42, counter to the force effect of the contact pressure spring 22, does indeed periodically press down and, in turn, move the second lever 16 by means of the roller 38, but the second lever 16 can no longer utilize the latch-type protrusion 48 of the retracted locking bolt 50 as a support element. On account thereof, the actuation or activation, respectively, of the gas exchange valve 36 is suppressed. Accordingly, the second lever 16 in the unlocking position as before does indeed periodically deflect in the case of a rotating camshaft 42, but does not entrain the first lever 14 in this pivoting movement.

Figure 2:
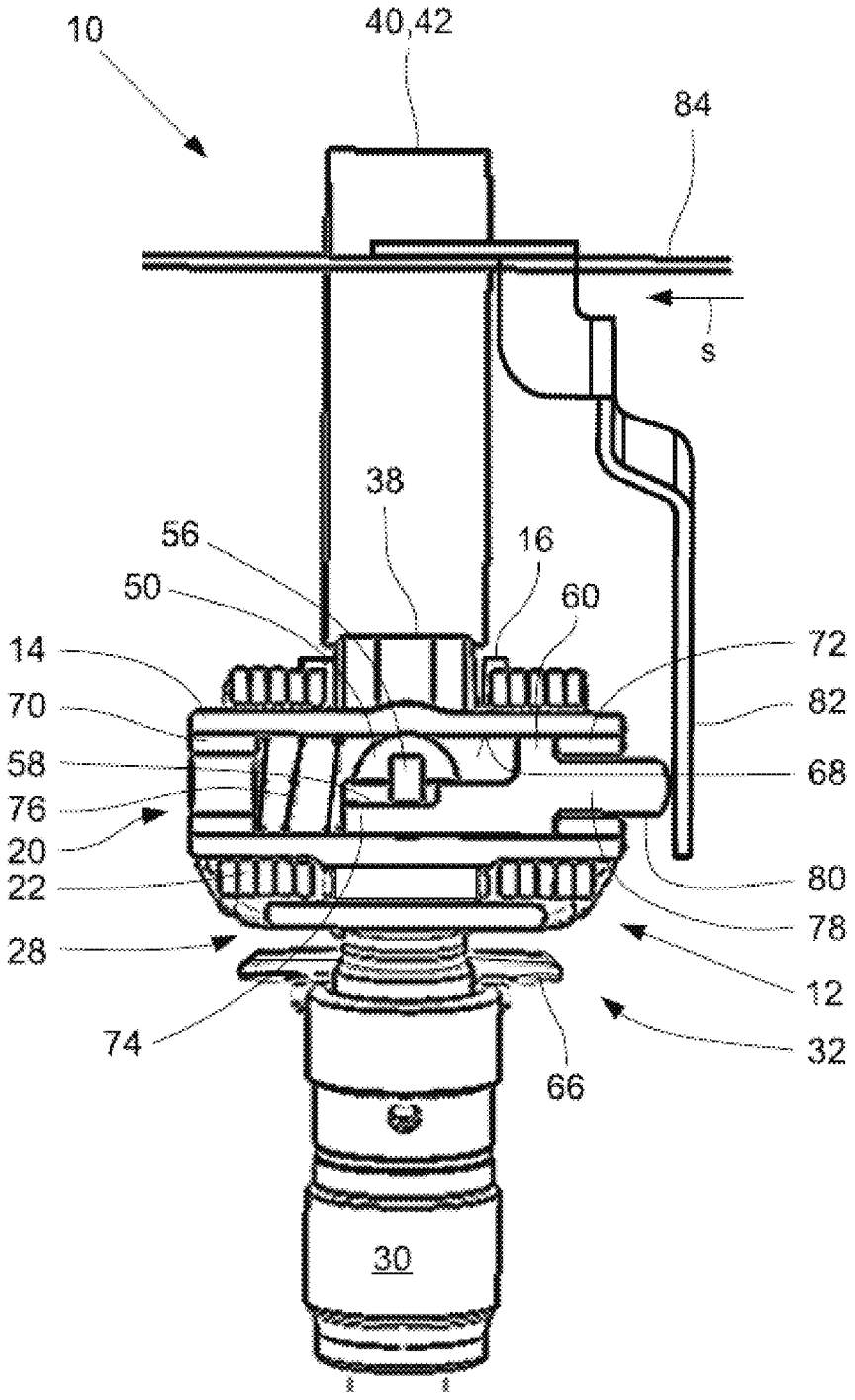
FIG. 2 shows a partially sectional rear view of the rocker arm according to FIG. 1, together with an assigned leaf spring which is fastened to an elongated activation arm.

FIG. 2 shows a partially sectional rear side view of the rocker arm 12 according to FIG. 1 at the side of the support element, together with the mentioned elongated activation arm 84. The rocker arm 12 of the valve drive 10 is supported in the region of the first end 28 of the first lever 14, as can be seen. A valve spring retainer 66 of the valve stem 34 (not to be seen in this view) of the gas exchange valve 36 is disposed in the region of the second end 32 of the first lever 14, said second end 32 facing away from the support element 30. As has already been explained, the activation of the second lever 16 by way of the roller 38 rotatably disposed there is performed by means of the cam 40 of the camshaft 42. The coupling 20 can be particularly readily seen in the sectional illustration of FIG. 2.

The coupling 20 has the locking bolt 50 which in this illustration is oriented so as to be substantially perpendicular to the image plane and which has the guide pin 56 which is disposed so as to be orthogonal to the locking bolt 50 and which is received so as to be displaceable in the gate-type guide 58 of the activation bolt 60. The activation bolt 60 is received in a cylindrical bore 68 of the first lever 14 so as to be longitudinally displaceable between a first end-side detent 70 and a second end-side detent 72. A spring element 76 which here is configured as a cylindrical compression spring is supported on the first detent 70 and on the first end portion 74 of the activation bolt 60.

A tapered activation pin 80 which at the end side is rounded in a convex manner is configured on a second end portion 78 of the activation bolt 60, said second end portion 78 facing away from the first end portion 74 of the activation bolt 60, said activation pin 80 by virtue of the force effect of the axially pretensioned spring element 76 bearing in an axially sprung manner on a leaf spring 82 of an elongated activation arm 84 that is configured as a thrust strip, said leaf spring 82 here configured in only an exemplary manner so as to be contoured in a bent manner.

The leaf spring 82 is disposed so as to be substantially orthogonal to the elongated activation arm 84. By virtue of the force effect of the spring element 76 on the rocker arm side, the activation bolt 60, upon sliding into the bore 68 by means of the leaf spring 82 of the elongated activation arm 84, returns in a self-acting manner to the non-activated resting position of said activation bolt 60 shown here, in which the rocker arm is in the locking position. On account of the axial sliding of the activation bolt 60, counter to the force effect of the spring element 76, into the bore 68 by an axial actuation path s, the rocker arm 12 proceeding from the locking position of the coupling 20 illustrated in FIG. 2 can be moved to the unlocking position of said coupling 20. On account of displacement movement of the elongated activation arm 84 performed counter to the actuation path s, the coupling 20 is switched back to the locking position thereof (see FIGS. 3 and 4). The activation of the activation bolt 60 is performed by way of the leaf spring 82 that is fastened to the elongated activation arm 84. This applies to all of the switchable rocker arms 12, 12*a* that are present within the valve drive 10.

Figure 3:
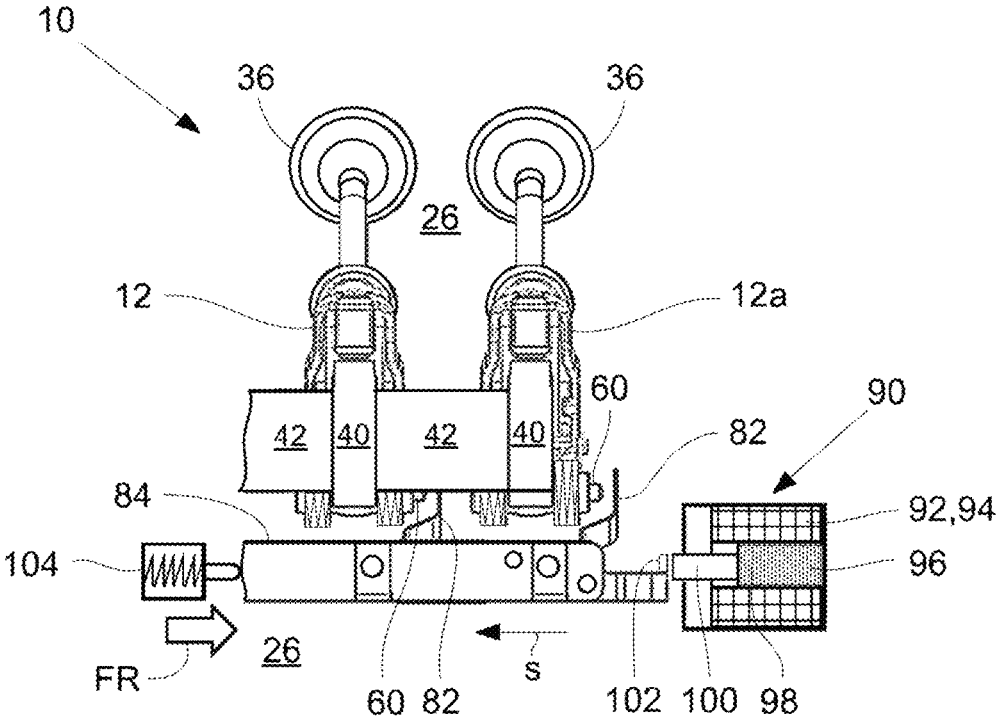
FIG. 3 shows an expanded illustration of the valve drive according to FIG. 1, having two rocker arms in the locking position thereof, said rocker arms being activatable by means of a linear actuator and the elongated activation arm.
Figure 4:
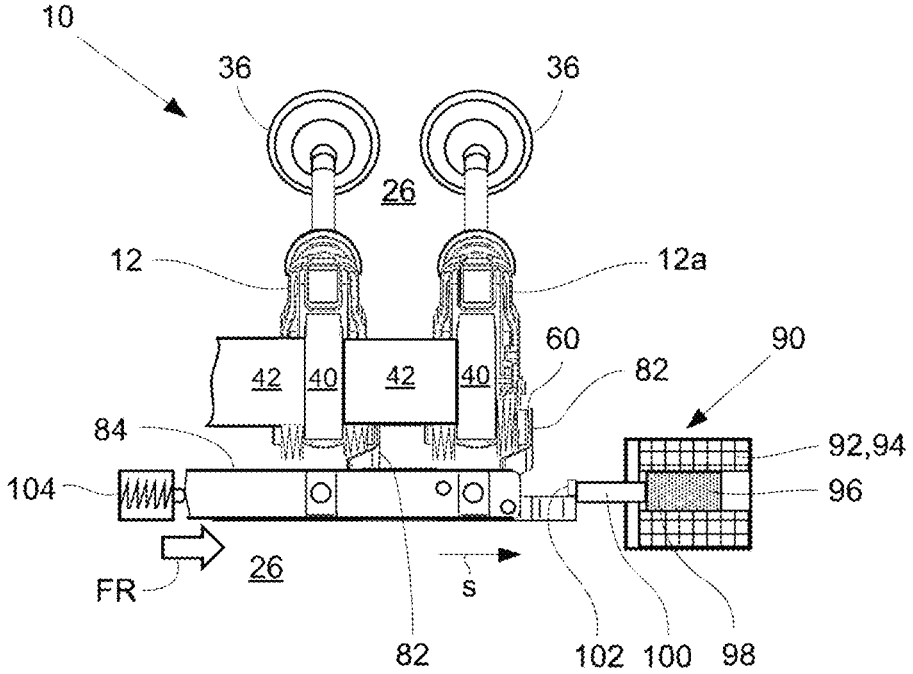
FIG. 4 shows the valve drive according to FIG. 3, having the two rocker arms in an unlocking position thereof.

FIGS. 3 and 4, to which reference is made at the same time in the further course of the description, in FIG. 3 show an expanded illustration of the valve drive 10 according to FIG. 1, having two rocker arms 12, 12*a* which are disposed in a directly neighboring manner and which by means of a linear actuator 90 are activatable by way of the elongated activation arm 84. The couplings 20 of the switchable rocker arms 12, 12*a* in FIG. 3 are in the static locking position thereof, while FIG. 4 shows the valve drive 10 in a situation in which the couplings 20 of the rocker arms 12, 12*a* are situated just before reaching the unlocking position thereof.

The two gas exchange valves 36 are activatable by means of the two rocker arms 12, 12*a* as well as the camshaft 42 having in each case the assigned cams 40 of the valve drive 10 of the internal combustion engine. Each of the two switchable rocker arms 12, 12*a* of the valve drive 10 shown here only in an exemplary manner possesses an activation bolt 60 which is in each case activatable by means of an assigned contoured leaf spring 82 of the elongated activation arm 84. The elongated activation arm 84 by means of guides (not illustrated) is guided so as to be longitudinally displaceable on the cylinder head 26 of the internal combustion engine and by means of the linear actuator 90 is displaceable by the axial actuation path s.

The linear actuator 90 in this exemplary embodiment is configured as an electromagnet 92 which has a substantially hollow cylindrical coil 94 in which an axially movable armature 96 is received. The armature 96 at one axial end 98 has a substantially cylindrical tappet 100. The elongated activation arm 84, at an axial end thereof that faces the linear actuator 90 for coupling to the tappet 100, has an angled contact tab 102 on which the tappet 100 can engage in order for the elongated activation arm 84 to be activated. In the non-energized state, or the voltage-free state, respectively, of the electromagnet 92 the tappet 100 by means of an actuator-internal spring (not illustrated) retracts axially in a self-acting manner to the position shown in FIG. 3.

The elongated activation arm 84 accordingly serves for the synchronous activation of the activation bolt 60 of the two rocker arms 12, 12*a*. Said elongated activation arm 84 can be produced in a simple and cost-effective manner as a standard component from a steel sheet or from a light-metal sheet. The contoured leaf springs 82 as well as the contact tab 102 can be molded integrally on the elongated activation arm 84 and/or as separate components be riveted, screwed, adhesively bonded, or otherwise fastened to said elongated activation arm 84.

In the situation illustrated in FIG. 3 the linear actuator 90, or the electromagnet 92, respectively, is illustrated so as to be non-energized and the tappet 100 so as to be axially retracted such that the contoured leaf springs 82 are at least slightly lifted from the activation bolt 60 of the rocker arms 12, 12*a* and the couplings 20 of the rocker arms 12, 12*a* are therefore situated in the locking position thereof. A switch from the locking position to the unlocking position of the couplings 20 of the rocker arms 12, 12*a* in the case of a non-energized linear actuator 90 is performed by axially sliding the elongated activation arm 84 backward, counter to the actuation path s in FIG. 3, with the aid of a spring-loaded resetting assembly 104 which exerts an axial resetting force FR on the activation arm 84.

As opposed to FIG. 3, the electromagnet 92 in FIG. 4 is illustrated so as to be energized such that the tappet 100 has assumed the maximum axial deployment position thereof. Consequently, the leaf springs 82 of the elongated activation arm 84 press the activation bolt 60 of the two rocker arms 12, 12*a* practically completely into the assigned bores 68 such that the couplings 20 of the two rocker arms 12 are switched synchronously to the unlocking position of said couplings 20.

It is also relevant in this context that the tappet 100, and conjointly therewith the elongated activation arm 84, are very intensely accelerated on account of the impulse-like energizing of the electromagnet 92. The tappet, loaded by an actuator-internal restoring spring, subsequently returns to the non-activated position of said tappet. Consequently, the contact tab 102 of the elongated activation arm 84 is lifted from the tappet 100, and the activation arm 84 moves on its own until the actuation bolt 60 on the actuator side impacts the mentioned detent 72 on the rocker arm side. After the coupling 20 has been switched to the unlocking position thereof, the elongated activation arm 84, driven by the spring effect of the respective leaf springs 82 and the axial resetting force FR, moves back toward the tappet 100 of the linear actuator 90, the contact tab 102 of the elongated activation arm 84 finally impacting the free end of said tappet 100.

By virtue of the movements described, in particular of the tappet 100 and of the contact tab 102 of the elongated activation arm 84, undesirable mechanical oscillations or vibrations, respectively, can arise within the valve drive 10. This effect is moreover facilitated on account of the high actuation frequencies of up to 100 Hz of the linear actuator 90 of the valve drive 10 which are required in the operation of an internal combustion engine. Said undesirable oscillations can be effectively eliminated or else at least largely eliminated with the aid of the present disclosure.

Figure 5:
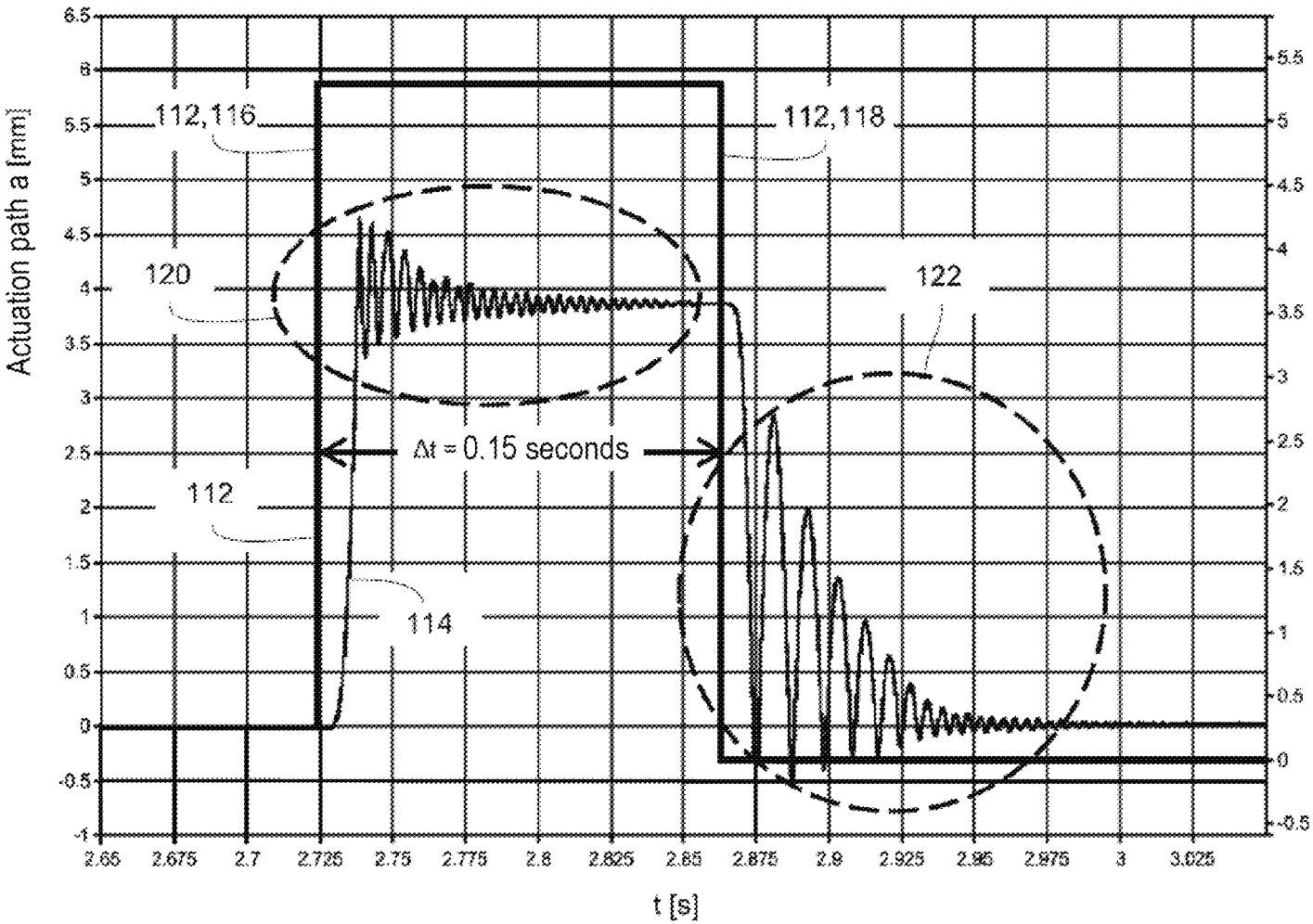
FIG. 5 shows a diagram with a temporal profile of the actuation path of a tappet of the linear actuator of the valve drive according to FIGS. 3 and 4.

FIG. 5 shows a diagram 110 in which the time tin seconds is plotted on the independent axis of said diagram 110. The actuation path a of the tappet 100 of the linear actuator 90 is plotted in millimeters on the dependent axis of the diagram 110 on the left side, and the electrical control voltage U in Volts of a switching signal that is applied to the electromagnet is plotted on the dependent axis on the right side. The diagram 110 moreover shows a temporal profile 112 of the control voltage U which serves for periodically energizing the linear actuator 90 of the valve drive 10, said actuator 90 being configured as an electromagnet. Moreover, a temporal profile 114 of an actuation path a of the tappet 100 of the linear actuator 90 of the valve drive 10 according to FIGS. 3 and 4 is illustrated.

The axial actuation path s of the elongated activation arm 84 having the leaf springs 82, as well as the actuation paths of the individual activation bolt 60 of the switchable rocker arms 12, 12*a*, at least in the case of a purely static observation, are substantially congruent with the temporal profile 114 of the axial actuation path a of the tappet 100 of the linear actuator 90 visualized here (path a≈path s).

The control voltage U applied to the linear actuator 90, or to the electromagnet 92 thereof, respectively, has an approximately rectangular temporal profile 112 having a period duration At of approximately 0.15 seconds. With an ascending flank 116 of the profile 112 of the control voltage U the switching of the rocker arms 12, 12*a* commences from the respective locking position to the unlocking position, while the switching back of the rocker arms 12, 12*a* from the unlocking position to the locking position is conversely initiated with a descending flank 118 in the profile 112 of the control voltage U.

As can be seen in the diagram 110, significant mechanical oscillations 120, 122 arise on the tappet 100 and thus also at least partially on the elongated activation arm 84 having the leaf springs 82, primarily in the region of the ascending flank 116 and of the descending flank 118 in the temporal profile 114 of the actuation path a of the tappet 100. The same applies in an analogous manner to the axial activation paths of the activation bolt 60 of the switchable rocker arms 12, 12*a*.

The oscillations 120, 122 have an approximately sinusoidal amplitude which exponentially decreases with the time t. The declared objective of the present disclosure is to ideally completely dampen these oscillations 120, 122 that are introduced into the elongated activation arm 84, or into the linear actuator 90, respectively, so as to avoid erroneous controlling of the switchable rocker arms 12 of the valve drive 10 in particular in the case of comparatively high actuation frequencies of the linear actuator 90, and to reduce the noise generation on the linear actuator 90. To this end, a damper mass which is connected to the elongated activation arm 84 so as to be capable of oscillating is utilized. The disclosure will therefore be illustrated in detail herein.

Figure 6:
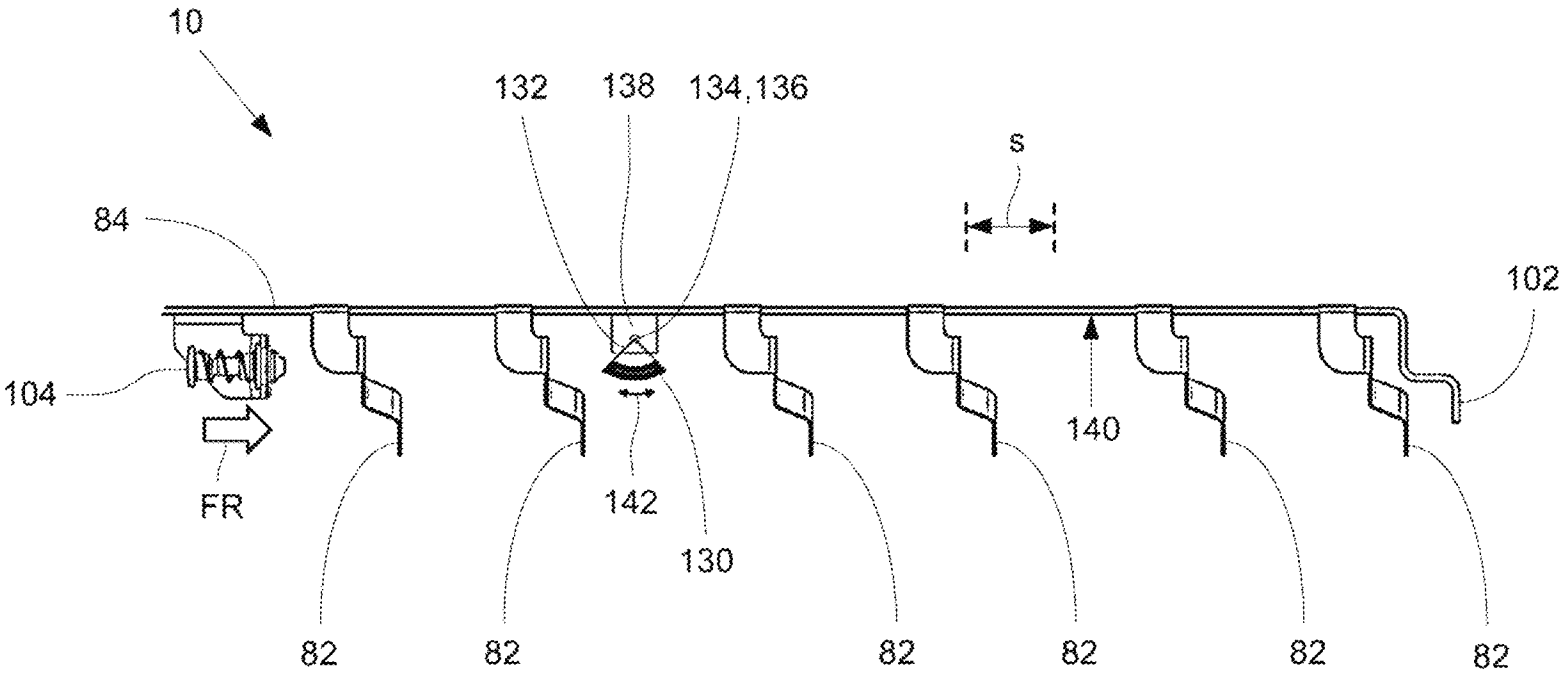
FIG. 6 shows a schematic perspective view of the elongated activation arm according to FIG. 2, having a first embodiment of a damper mass.

FIG. 6 schematically shows a perspective view of the elongated activation arm 84 according to FIG. 2 having a first embodiment of a damper mass. The elongated activation arm 84, configured as a thrust strip or a thrust bar, presently possesses in only an exemplary manner six contoured leaf springs 82 that are disposed so as to be approximately orthogonal, in order for a corresponding number of switchable rocker arms 12, 12*a* (not illustrated in the drawing here) of the valve drive 10 to be activated. The elongated activation arm 84 in the case of a non-energized or inactive, respectively, linear actuator 90, by means of the resetting assembly 104 is pushed back by the mechanical force FR in the direction toward the linear actuator 90 such that the switchable rocker arms 12, 12*a*, proceeding from the unlocking position of the couplings 20, switch back to the respective locking positions. This resetting process is moreover facilitated by the axially decompressing leaf springs 82.

As can be seen, a solid damper mass 130 is disposed on an end side of a pendulum arm 132, between two axially directly neighboring leaf springs 82 of the elongated activation arm 84. An end 134 of the pendulum arm 132 that is distant from the damper mass herein is articulated so as to be freely pivotable in a fulcrum 136 of a tab 138 of the elongated activation arm 84. The tab 138 is integrally molded so as to be orthogonal on the elongated activation arm 84, or as a separate component is fastened to the latter.

A pivot axis (not illustrated) which on the tab 138 of the articulated pendulum arm 132 runs so as to be perpendicular to the image plane, runs so as to be spaced apart in a substantially parallel manner to a longitudinal side 140 of the activation arm 84 that faces the leaf springs 82, said activation arm 84 here in an exemplary manner having a substantially rectangular cross-sectional geometry. The damper mass 130 has a three-dimensional shape which substantially corresponds to that of a sectoral fragment of a hollow cylinder. The damper mass 130 that is articulated so as to be pivotable on the elongated activation arm 84, when interacting with the pendulum arm 132, acts as a mass-spring system.

The elongated activation arm 84 is actuated at up to 100 Hz by means of the linear actuator 90 (not illustrated here) which engages on the contact tab 102, and consequently is periodically displaced back and forth in a reciprocal manner at this frequency by the axial actuation path s. The damper mass 130 that is articulated so as to swing on the elongated activation arm 84 is in turn thus excited so as to perform oscillating movements which are symbolized by a small double arrow 142. The mass of the damper mass 130, for achieving an optimal oscillation damping effect, is dimensioned such that said mass ideally completely compensates the oscillations of the elongated activation arm 84, having the leaf springs 82 disposed thereon, to be eliminated.

Figure 7:
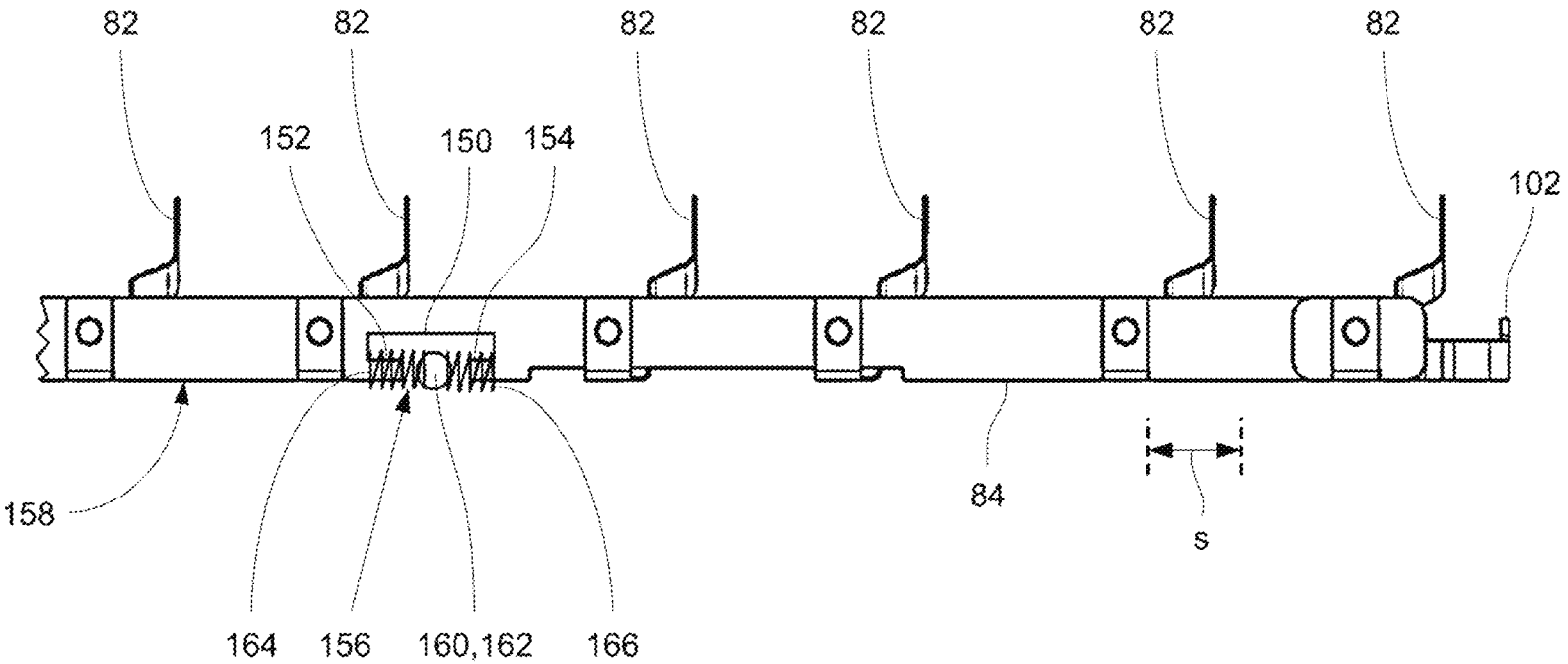
FIG. 7 shows a schematic perspective view of the elongated activation arm according to FIG. 2, having a second embodiment of a damper mass.

FIG. 7 schematically shows a perspective view of the elongated activation arm according to FIG. 2 having a second embodiment of a damper mass according to the disclosure. Deviating from the first embodiment illustrated in FIG. 6, a rectangular recess 150 in which a damper mass 160 is disposed is formed here between two directly neighboring leaf springs 82 in the elongated activation arm 84. The actuation of the elongated activation arm 84 having the leaf springs 82 disposed thereon is performed by means of the tappet 100 of the linear actuator 90 (not illustrated here), by way of the angled contact tab 102 of the activation arm 84. By virtue of said actuation, the elongated activation arm 84 is axially displaceable by the actuation path s.

An approximately cuboid first protrusion 152 and a second protrusion 154 are molded so as to be mutually opposite in the region of a narrow side of the rectangular recess 150, said narrow side not being identified for the sake of improved clarity in the drawing. The two protrusions 152, 154 are configured so as to be mutually aligned while leaving an intermediate space 156, and so as to be flush with a narrow side 158 of the elongated activation arm 84 that has a rectangular cross-section geometry. A damper mass 160 is received in an axially sprung manner in the intermediate space 156, between mutually facing free ends of a first and a second damper spring 164, 166, wherein the two damper springs 164, 166 are in each case configured as cylindrical compression springs and in portions are in each case received on one of the protrusions 152, 154. The damper springs 164, 166 are in each case supported on the narrow sides of the rectangular recess 150.

The damper mass 160 here in only an exemplary manner is configured as a solid ball 162; alternatively thereto, said damper mass 160 can also have a geometry that deviates therefrom. For example, the damper mass 160 can be configured as a solid cylinder having in each case tapered ends which are capable of being received in the free ends of the damper springs 164, 166. Alternatively thereto, a continuous cylindrical damper spring (not illustrated in the drawing) can be clamped on both sides axially between the two protrusions 152, 154, wherein the spherical or a cylindrical damper mass can be fastened for example by press-fitting, jamming, adhesive bonding, or in another manner, so as to be centric within the damper spring which in terms of the diameter thereof is correspondingly dimensioned.

The mass of the ball 162 which by means of the damper springs 164, 166 is mounted so as to be axially sprung, in combination with the spring forces of the two damper springs 164, 166, for achieving optimal results is again dimensioned such that the natural frequency of said ball 162 in terms of oscillation damping corresponds to a frequency of the valve drive 10 that is primarily to be dampened, and in particular of the elongated activation arm 84 having the contoured leaf springs 82 disposed thereon.

Figure 8:
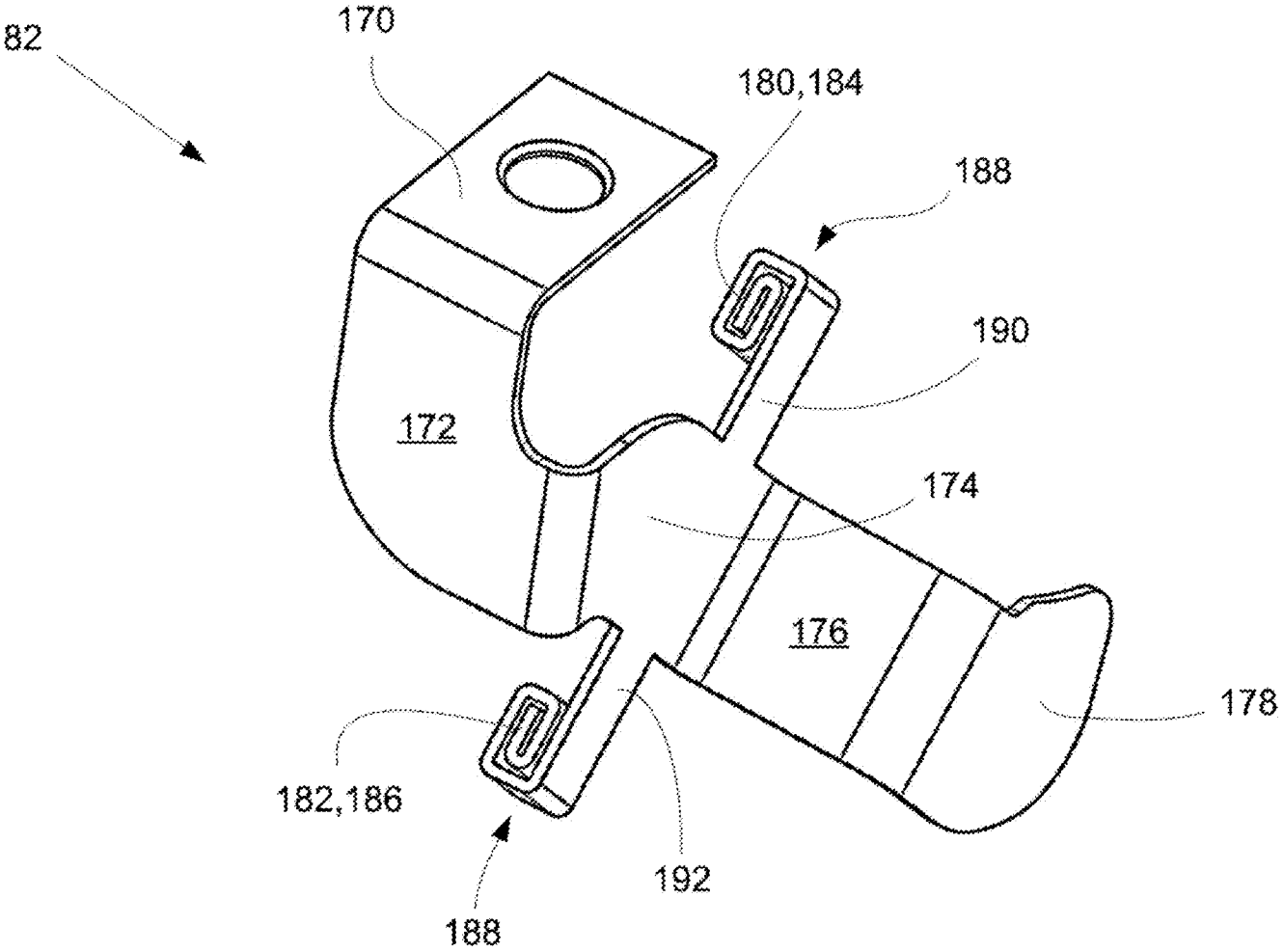
FIG. 8 shows a perspective view of a leaf spring of the activation arm according to FIG. 2, having a third embodiment of a damper mass.

FIG. 8 shows a perspective view of a leaf spring 82 of the elongated activation arm 84 according to FIG. 2 having a third embodiment of a damper mass. The contoured leaf spring 82 of the valve drive 10 possesses a fastening portion 170 having a cylindrical bore (not identified). An angled portion 172 which is edge-bent by approximately 90° adjoins the fastening portion 170, said angled portion 172 in turn transitioning to a first rectilinear portion 174, a slightly contoured intermediate portion 176, or an intermediate portion 176 that runs so as to be slightly inclined, respectively, as well as a second rectilinear portion 178, the latter acting as a contact face, or activation face, respectively, for the activation bolt 60 of the switchable rocker arms 12, 12*a*. The angled portion 172 has an approximately quadrant-shaped geometry. The two rectilinear portions 174, 178 that are separated by the intermediate portion 176 run so as to be substantially mutually parallel.

Two mutually opposite thickenings 184, 186 which in each case act as a compact or massive, respectively, damper mass 180, 182 on both sides of the rectilinear portion 174 here are in each case molded integrally from a material portion 188 of the leaf spring 82. The thickenings 184, 186 on both sides can be implemented, for example, by folding a part of an assigned material portion 188 of the leaf spring 82 multiple times in a meandering manner. The two damper masses 180, 182 are moreover in each case linked to the first rectilinear portion 174 by means of a single-ply material web 190, 192 which lies in a plane of the first rectilinear portion 174. The single-ply material webs 190, 192 act like elastic damper springs for linking the two compact damper masses 180, 182 to the leaf springs 82 in a spring-elastic manner.

Moreover, a natural frequency of the damper masses 180, 182 that are connected in a sprung manner to the leaf spring 82 is adapted to an undesirable primary oscillation of the valve drive 10 to be ideally completely eliminated, or of the elongated activation arm 84 (not plotted here) and/or of the leaf springs 82 of the latter, respectively.

The material webs 190, 192 having the compact damper masses 180, 182 configured thereon at the end sides likewise run so as to be parallel to a plane that is defined by the second rectilinear portion 178, wherein the second rectilinear portion 178 in turn is specified as a contact face for an activation bolt 60 of the switchable rocker arms 12, 12*a* of the valve drive 10.

The integral configuration of the two damper masses 180, 182, and the linkage thereof by means of the single-ply material webs 190, 192 that act like damper springs is readily implementable using conventional sheet-metal forming methods. Forming methods of this type permit a cost-effective production of the leaf springs 82 and/or of the elongated activation arm 84 that is suitable for large volumes, along with a high dimensional accuracy that is reliably reproducible.

LIST OF REFERENCE CHARACTERS

10 Variable valve drive
12 Switchable rocker arm
12*a* Switchable rocker arm
14 First lever of the rocker arm
16 Second lever of the rocker arm
20 Coupling of the rocker arm
22 Contact pressure spring, leg spring of the rocker arm
24 Journal pin of the rocker arm
26 Cylinder head of an internal combustion engine
28 First end of the rocker arm
30 Support element, hydraulic valve lash compensation element
32 Second end of the rocker arm
34 Valve stem of a gas exchange valve
36 Gas exchange valve
38 Roller on the second lever of the rocker arm
40 Cams of a camshaft
42 Camshaft
48 Latch-type protrusion on the locking bolt
50 Locking bolt
52 Bearing face on the second lever of the rocker arm
54 Arrow, activation direction
56 Guide pin
58 Gate-type guide
60 Activation bolt
66 Valve spring retainer
68 Bore
70 First detent
72 Second detent
74 First end portion of the activation bolt
76 Spring element for the activation bolt
78 Second end portion of the activation bolt
80 Activation pin
82 Contoured leaf spring
84 Elongated activation arm
90 Linear actuator
92 Electromagnet of the linear actuator
94 Coil of the electromagnet
96 Armature of the linear actuator
98 Axial end of the armature
100 Tappet
102 Angled contact tab of the activation arm
104 Resetting assembly for the elongated activation arm
110 Diagram
112 Profile of a control voltage U
114 Profile of the actuation path a of the tappet
116 Ascending flank of the control voltage U
118 Descending flank of the control voltage U
120 First oscillation
122 Second oscillation
130 Damper mass
132 Pendulum arm
134 Damper-mass-free end of the pendulum arm
136 Fulcrum
138 Tab
140 Longitudinal side of the activation arm
142 Double arrow, oscillation movement
150 Rectangular recess
152 First protrusion in the recess
154 Second protrusion in the recess
156 Intermediate space
158 Narrow side of the activation arm
160 Damper mass
162 Ball
164 First damper spring
166 Second damper spring
170 Fastening portion
172 Angle portion
174 First rectilinear portion
176 Contoured intermediate portion
178 Second rectilinear portion
180 Damper mass
182 Damper mass
184 First thickening
186 Second thickening
188 Material portion of the leaf spring
190 First single-ply material web
192 Second single-ply material web
a Axial actuation path of the tappet of the linear actuator
FR Resetting force of the resetting assembly
s Axial actuation path of the elongated activation arm
t Time
U Control voltage

The invention claimed is:

1. A variable valve drive of an internal combustion engine, the variable valve drive having:
- a switchable rocker arm including:
  - a first lever; and
  - a second lever configured to be: (i) pivotably mounted to the first lever, and (ii) selectively coupled to the first lever by a coupling;
  - one end of one of the first or second lever configured to be supported by a support element mounted on a housing side, and another end of the first or second lever configured to be supported by a valve stem of a gas exchange valve;
  - the coupling activatable by a leaf spring configured on an elongated activation arm, the elongated activation arm longitudinally displaceable from a locking position to an unlocking position by a linear actuator; and
  - at least one damper mass configured to oscillate on at least one of the elongated activation arm or the leaf spring, and the linear actuator configured as an electromagnet having an armature that is axially movable in a coil, wherein an axial end of the armature is rigidly connected to a tappet.

2. The variable valve drive as claimed in claim 1, wherein the at least one damper mass is configured on an end side of a pendulum arm, and a damper-mass-free end of the pendulum arm is arranged to be freely pivotable on the elongated activation arm.

3. The variable valve drive as claimed in claim 1, wherein the at least one damper mass includes at least one ball disposed on the elongated activation arm, the at least one ball configured to be displaceable between two mutually opposite damper springs.

4. The variable valve drive as claimed in claim 1, wherein the at least one damper mass is formed by at least one integral thickening of the leaf spring.

5. The variable valve drive as claimed in claim 4, wherein the at least one integral thickening is formed by folding over at least once a material portion of the leaf spring.

6. The variable valve drive as claimed in claim 4, wherein the at least one integral thickening is linked to the leaf spring by a single-ply material web, the single-ply material web configured as an elastic damper spring.

7. The variable valve drive as claimed in claim 1, wherein the elongated activation arm has an angled contact tab configured to be engaged by the tappet for moving the elongated activation arm.

8. The variable valve drive as claimed in one of claim 1, wherein the coupling of the switchable rocker arm has a locking bolt which is displaceable in a direction parallel to the first lever and has a guide pin which is received and guided by an activation bolt, the activation bolt transversely oriented to the locking bolt and pretensioned by a spring in an axially outward direction.

9. The variable valve drive as claimed in claim 8, wherein the locking bolt has a protrusion which is configured to engage below at least a portion of a bearing face of the second lever.

10. A variable valve drive of an internal combustion engine, the variable valve drive having:

an elongated activation arm configured to be longitudinally displaceable from a locking position to an unlocking position by a linear actuator, the elongated activation arm having at least one damper mass configured to oscillate on the elongated activation arm; and at least one switchable rocker arm having:

a first lever;

a second lever pivotably mounted to the first lever; and a coupling activated by the elongated activation arm to selectively couple the second lever to the first lever, the coupling having:

a locking bolt displaceable in a direction parallel to the first lever; and an activation bolt transversely oriented to the locking blot and pretensioned by a spring in an axially outward direction, the activation bolt configured to receive the locking bolt.

11. The variable valve drive of claim 10, wherein the elongated activation arm includes at least one leaf spring that is configured to move the coupling of the at least one switchable rocker arm.

12. The variable valve drive of claim 11, wherein the at least one leaf spring is disposed substantially orthogonal to the elongated activation arm.

13. An elongated activation arm for a variable valve drive of an internal combustion engine, comprising:

a first end configured to receive an actuator;

at least one leaf spring configured to actuate at least one switchable rocker arm; and at least one damper mass configured to oscillate on at least one of the elongated activation arm or the at least one leaf spring, the at least one damper mass:

i) configured on a first end of a pendulum arm, and a second end of the pendulum arm arranged to pivot on the elongated activation arm, or ii). including at least one ball configured to be axially displaceable between two mutually opposite damper springs; or iii) formed by at least one integral thickening of the at least one leaf spring.

14. The elongated activation arm of claim 13, wherein the elongated activation arm includes a second end configured to receive a resetting assembly that moves the elongated activation arm to an unlocked position.

15. The elongated activation arm of claim 13, wherein the second end of the pendulum arm is configured as a damper-mass-free end.

16. The elongated activation arm of claim 13, wherein the at least one integral thickening is linked to the at least one leaf spring by a single-ply material web, the single-ply material web configured as an elastic damper spring.

17. The elongated activation arm of claim 13, configured to move longitudinally to a locking position and an unlocking position.

* * * * *